US005286347A

United States Patent [19]

Richardson

[11] Patent Number: 5,286,347

[45] Date of Patent: Feb. 15, 1994

[54] MELAMINE FORMALDEHYDE POLYMER FOR PITCH CONTROL METHOD

[75] Inventor: Paul F. Richardson, Mt. Lebanon, Pa.

[73] Assignee: Calgon Corporation, Pittsburgh, Pa.

[21] Appl. No.: 878,637

[22] Filed: May 5, 1992

[51] Int. Cl.[5] ..... D21C 9/08; D21H 21/02

[52] U.S. Cl. ..... 162/199; 162/166; 162/DIG. 4

[58] Field of Search ..... 162/199, DIG. 4, 5, 162/8, 166, 167

[56] References Cited

U.S. PATENT DOCUMENTS

| | | | |
|---|---|---|---|
| 2,986,489 | 5/1961 | Maxwell | 162/166 |
| 3,582,461 | 6/1971 | Lipowski et al. . | |
| 3,703,563 | 11/1972 | Lipowski et al. | 162/DIG. 4 |
| 3,812,055 | 5/1974 | Carstens et al. . | |
| 3,895,164 | 7/1975 | Carstens et al. . | |
| 3,896,046 | 7/1975 | Carstens et al. . | |
| 3,992,249 | 11/1976 | Farley . | |
| 4,313,790 | 2/1982 | Pelton et al. . | |
| 4,629,572 | 12/1986 | Leitz et al. . | |
| 4,656,059 | 4/1987 | Mizuno et al. . | |
| 4,913,775 | 4/1990 | Langley et al. | 162/164.6 |
| 4,935,149 | 6/1990 | Morse . | |
| 4,950,361 | 8/1990 | Bender et al. . | |
| 5,068,279 | 11/1991 | Morse . | |

FOREIGN PATENT DOCUMENTS

| | | | |
|---|---|---|---|
| 50223 | 4/1982 | European Pat. Off. | 162/166 |
| 280445 | 10/1990 | European Pat. Off. . | |

*Primary Examiner*—Karen M. Hastings

*Attorney, Agent, or Firm*—W. C. Mitchell; C. M. Caruso

[57] ABSTRACT

A method for inhibiting the deposition of pitch on and/or for removing pitch from the surfaces of pulping and papermaking machinery by adding an effective amount of a melamine formaldehyde-type polymer to a pulp slurry or furnish in contact with said machinery.

4 Claims, No Drawings

MELAMINE FORMALDEHYDE POLYMER FOR PITCH CONTROL METHOD

BACKGROUND OF THE INVENTION

The present invention relates to the use of melamine aldehyde-type polymers to inhibit pitch deposition in pulping and papermaking processes. More particularly, this invention relates to inhibiting the deposition of pitch on machinery used in pulping and papermaking processes and to the removal of pitch from machinery used in pulping and papermaking processes.

Pitch continues to be a problem in pulp and paper mills. It is believed that the problems caused by the build up of pitch on pulp and papermaking machinery and in the final paper cost the pulp and paper industry many millions of dollars per year in lost production. Pitch, as used herein, may be generally defined as any resin-based deposit of widely varying composition originating in the extractive fraction of wood. The extractive fraction of wood is one of the four principal components of wood. The other three are cellulose, lignin, and hemicellulose. The extractive fraction is defined as a complex mixture of substances which are soluble in water, alcohol, benzene, ether, and/or acetone. The extractive fraction, which generally makes up from about 3% to 10% of the weight of wood, contains such components as low molecular weight carbohydrates, terpenes, aromatic and aliphatic acids, alcohols, tannins, color substances, proteins, lignins, alkaloids, and soluble lignins.

Pitch is a major problem in pulp and papermaking because it (1) agglomerates and also occludes other matter to form visible "dirt" in the final paper, (2) plates out and collects on machinery used in pulping and papermaking process such as screens, filters refining equipment, pulp washers, and paper machines, and (3) reduces pulp brightness and brightness stability. The composition and amount of pitch deposited on pulping and papermaking machinery and in the final paper varies with the time of the year the trees are harvested, the type of wood, and the type of the pulping process used. For example, wood pulped from trees cut in the early spring and fall generally contains more pitch than wood pulped from trees cut at other times during the year. Pitch deposited in softwood Kraft mills tends to have a relatively larger abietic acid to fatty acid-ester ratio than pitch found in hardwood Kraft mills, and pitch deposit problems are generally somewhat more severe in sulfite mills. The sulfite pulping process removes only about one half of the resins and fatty esters leaving a considerable portion of these materials encapsulated within the cellulose fibers. However, these encapsulated materials are released by the shearing forces of pulping and papermaking processes and thus pitch deposits are more prevalent in the stock preparation area and on the paper machine. Pitch problems can be quite bothersome in mechanical pulp mills, including groundwood, TMP, CTMP, and semi-chemical pulping processes, particularly those that utilize softwoods. This is because there is little chemical degradation of the fatty acid esters and resin esters. Therefore, those materials are not washed out and tend to remain dispersed in the aqueous system of the pulping process.

The presence of calcium carbonate in the pulping process exacerbates the problem of pitch deposition on pulp and papermaking machinery. Crystallized calcium carbonate can provide nucleation sites for precipitated metal soaps thereby producing hydrophobic particles which coalesce with other particles to form a pitch deposit.

There have been many attempts over the years to eliminate pitch problems by adding pitch control agents to pulping and/or papermaking processes. While more thorough pulp washing may help to reduce pitch problems, the most common methods of treatment involve the addition of dispersants or adsorbant fillers to the furnish. For example, treatments may involve the use of alum, talc, anionic pitch-control agents such as polynaphthalene sulfonates or modified lignosulfonates, cationic pitch control agents such as polyquaternary ammonium polymers, methylcellulose derivatives and nonionic surfactants. None of these treatments are believed to be particularly effective.

Examples of the use of poly quaternary ammonium polymers as pitch control agents can be found in U.S. Pat. No. 3,582,461. The '461 patent discloses the use of water soluble dicyandiamide-formaldehyde condensates to prevent pitch deposition on machinery used in pulping and papermaking processes. By contrast, the instant invention utilizes water insoluble acid colloids.

Examples of attempts to control pitch with other types of compounds or processes are found in U.S. Pat. Nos. 3,812,055; 3,895,164; 3,896,046; 3,992,249; 4,313,790.

Zirconium chemicals have also been used to control pitch. See, for example, U.S. Pat. No. 4,950,361.

The instant melamine formaldehyde-type polymers are widely used in water treatment, particularly in the treatment of paint spray booths. See, for example, U.S. Pat. Nos. 4,656,059, 4,629,572, 4,935,149 and 5,068,279.

However, the use of melamine formaldehyde-type polymers to control pitch deposition in papermaking is not known or suggested in the art.

As indicated above, the present invention relates to the inhibition and/or control of pitch in papermaking operations. A copending, commonly assigned application (U.S. Ser. No. 08/023,988; filed Mar. 1, 1993) relates to the control of "stickies" using substantially the same chemistry as is discussed herein. While pitch is defined as the material comprising naturally occurring resinous materials and gums liberated during the screening, heating and refining processes that occur during papermaking, stickies are defined as synthetic additives which enter into paper furnishes. More particularly, stickies are defined as adherent deposits caused by organic materials used in paper and board converting operations which are typically introduced into paper machine furnishes with recycled fibers. The word "stickies" is derived from the fact that the resultant deposits stick to wires, felts, and other parts of paper machine. Stickies are a diverse mixture of synthetic materials ranging from hot-melt and pressure-sensitive adhesives to binders and coatings for inks or wet strength resins. Polymeric examples include, for example, polyethylenes, polybutadiene-styrenes, polyvinylacetates and polyacrylates.

SUMMARY OF THE INVENTION

The instant invention is directed to the inhibition of pitch deposits on and to the removal of pitch deposits from pulping and/or papermaking machinery, particularly wet-end papermaking machinery, comprising adding to a pulp slurry or paper furnish in contact with said machinery an effective amount of a designated melamine formaldehyde-type polymer.

DETAILED DESCRIPTION OF THE INVENTION

The present invention relates to a method for inhibiting pitch deposition on papermaking equipment or machinery, and/or for removing existing pitch deposits from such equipment or machinery, comprising adding to a furnish, stock or papermaking stream containing pitch which contacts with said equipment or machinery an effective amount of a melamine formaldehyde-type polymer.

An effective amount of a melamine formaldehyde-type polymer must be used. As used herein, the melamine formaldehyde-type polymer is a polymer comprising: (a), melamine or a substituted melamine; and (b) a compound described by the following formula:

$$R_1-\overset{\overset{\displaystyle O}{\|}}{C}-R_2$$

wherein $R_1$ and $R_2$, which may be the same or different, are selected from the group consisting of H and straight or branched $C_{1-4}$ alkyl groups. The preferred compounds of (b) comprise aldehydes, with methanal (formaldehyde), ethanal and propanal being especially preferred; the most preferred aldehyde is formaldehyde. Also, moderate amounts of additional moieties, including, for example, urea and/or dicyandiamide, may be present in the melamine formaldehyde-type polymers of this invention.

Irrespective of the presence of additional moieties, however, the mole ratio of component (a) to component (b) should range from about 1:1 to about 1:6, with the preferred ratio being from about 1:1 to 1:3. The most preferred mole ratio is about 1 mole of melamine or a derivative thereof to about 2 to 2.5 moles of an aldehyde. Thus, the most preferred polymer is prepared from melamine and formaldehyde with the mole ratio of melamine to formaldehyde being about 1:2 to about 1:2.5.

The instant melamine-formaldehyde polymers are insoluble in water. They are therefore best utilized in acidic solutions wherein the melamine polymer is stabilized in a fine colloidal state of suspension. Calgon's product CA-289, which has a pH of about 1.6 to about 2.1, is an example of the preferred form. This product contains 8% active melamine-formaldehyde polymer in an acidic aqueous solution. Any acid can be used to prepare the melamine aldehyde acid suspension, although hydrochloric acid is preferred. Also, other stabilizing agents, such as alcohols, can be used.

The percent by weight of active melamine polymer in a stabilized (acidic) suspension or solution should range from about 0.1% to about 20%, preferably 1% to. about 15%, and most preferably about 4% to about 12%, due to cost and product stability considerations. The pH should be sufficiently low to keep the melamine aldehyde-type polymer in a fine colloidal suspension.

The molecular weight of the melamine aldehyde-type polymer is not critical. However, the preferred molecular weight ranges from about 500 to about 50,000, and the most preferred molecular weight ranges from about 500 to about 5,000. As noted above, suitable melamine aldehyde-type polymers are commercially available from Calgon Corporation, under the tradenames CA-289 and WT-2511. These products have molecular weights of about 2,200.

An effective amount of the melamine formaldehyde-type polymer should be added to or maintained in the furnish or papermaking stream being treated. The melamine polymer interacts with the pitch contained in such streams, thereby inhibiting pitch deposition and/or removing existing pitch deposits from the surface of papermaking equipment. As used herein, the term "effective amount" refers to that amount of melamine formaldehyde-type polymer which achieves the desired inhibition or removal of pitch for a given system.

The melamine polymer can be applied intermittently or continuously to the papermaking stream being treated at a preferred dosage of at least about 0.01 lb. polymer per ton of dry fiber, on an active polymer basis. More preferably, the dosage should be maintained between about 0.40 lb/ton to about 10.0 lb/ton. The melamine formaldehyde-type polymer can be added at any convenient location, but is preferably added so as to allow the maximum contact between melamine formaldehyde-type polymer and the pitch. For example, the melamine formaldehyde-type polymer may be added to brown stock washers, deckers, high density chests or machine dilution chests. Also, multiple points of addition may be used.

EXAMPLES

Example 1

Paper Mill Trial

Calgon product CA-289 was fed to a small storage chest after the outside brown stock high density chest of a bleached softwood Kraftmill. The trial used fresh wood chips. The stock, after treatment, went through the screening room and eventually to the bleach plant. The feed rate ranged from 2 to 10 lb of 8%, by weight, active polymer per (dry fiber basis) ton of furnish. This equates to a feed rate of about 0.16 to about 0.8 lb per ton, on an active polymer basis.

Visual observations during the trial of the screens room and the reject cleaner—cones in the bleach plant indicated that they were virtually free of pitch. Further, pulp staining demonstrated a significant decrease in the amount of loose pitch in the system i.e., colloidal and sheared off encapsulated pitch. The pitch plate deposition in the screened room decreased slightly (8%) after the trial.

The Uhle boxes in the press section of the paper machine were cleaned one day before and one day after the colloidal melamine formaldehyde trial. No white pitch or scale deposits were found in the Uhle boxes. This treatment replaced an effective AZC program.

What is claimed is:

1. A method for inhibiting pitch deposition on pulping and papermaking equipment or machinery comprising adding to a pulp slurry containing pitch which contacts said equipment or machinery, an effective amount of a water-insoluble melamine formaldehyde-type polymer acid colloid, wherein said water-insoluble melamine formaldehyde-type polymer acid colloid comprises (a), melamine or a substituted melamine; and (b) a compound described by the following formula:

$$R_1-\overset{\overset{\displaystyle O}{\|}}{C}-R_2$$

wherein $R_1$ and $R_2$ which may be the same or different are selected from the group consisting of H and straight or branched $C_{1-4}$ alkyl groups wherein the melamine formaldehyde-type polymer has a molecular weight range from about 500 to about 5000, and said effective amount is between about 0.01 lb. to about 10 lb. polymer, on an active basis, per ton of dry fiber.

2. The method of claim 1, where b) is formaldehyde.

3. The method of claim 1, wherein the mole ratio of a):b) is about 1:1 to about 1:16.

4. The method of claim 2, wherein the mole ratio of a):b) is about 1:1 to about 1:6.

* * * * *